US007305899B2

(12) United States Patent
Kajino et al.

(10) Patent No.: US 7,305,899 B2
(45) Date of Patent: Dec. 11, 2007

(54) STARTER WITH STOPPER ON CLUTCH INNER PORTION OF ONE-WAY CLUTCH

(75) Inventors: Sadayoshi Kajino, Nagoya (JP); Youichi Hasegawa, Kasugai (JP); Kei Shibayama, Nagoya (JP)

(73) Assignee: Denso Corporation, Kariya (JP)

( * ) Notice: Subject to any disclaimer, the term of this patent is extended or adjusted under 35 U.S.C. 154(b) by 570 days.

(21) Appl. No.: 10/795,283

(22) Filed: Mar. 9, 2004

(65) Prior Publication Data

US 2004/0177710 A1 Sep. 16, 2004

(30) Foreign Application Priority Data

Mar. 11, 2003 (JP) ..... 2003-064791

(51) Int. Cl.
*F02N 11/02* (2006.01)
*F02N 15/06* (2006.01)

(52) U.S. Cl. ..... 74/7 C; 74/7 E

(58) Field of Classification Search ..... 74/7 R, 74/7 A, 7 B, 7 C, 7 D, 7 E, 8
See application file for complete search history.

(56) References Cited

U.S. PATENT DOCUMENTS 2,526,127 A * 10/1950 Gilbert ..... 74/7 C
4,760,274 A * 7/1988 Isozumi ..... 290/48
4,941,366 A * 7/1990 Isozumi ..... 74/6
5,067,357 A * 11/1991 Isozumi ..... 74/7 E
5,370,009 A 12/1994 Isozumi
6,851,405 B2 * 2/2005 Kajino et al. ..... 123/179.25
6,963,144 B2 * 11/2005 Kurasawa et al. ..... 290/38 R

FOREIGN PATENT DOCUMENTS

| | | |
|---|---|---|
| EP | 0 494 681 A1 | 7/1992 |
| JP | 49-130237 | 3/1948 |
| JP | A 61-101670 | 5/1986 |
| JP | A 63-266167 | 11/1988 |
| JP | A 02-207177 | 8/1990 |
| JP | A 02-224843 | 9/1990 |
| JP | Y2 6-23742 | 6/1994 |
| JP | 08170575 A * | 7/1996 |
| JP | A 08-170575 | 7/1996 |

* cited by examiner

*Primary Examiner*—Richard Ridley
*Assistant Examiner*—Terence Boes
(74) *Attorney, Agent, or Firm*—Oliff & Berridge, PLC

(57) ABSTRACT

In a starter, a one-way clutch that transmits rotation of a motor to an output shaft has a clutch inner portion. The clutch inner portion has female helical splines in an inner periphery. Also, the clutch inner portion has a stopper at a front end of the female helical splines on the side opposite to the motor. The female helical splines engage with male helical splines formed on a rear end of the output shaft so that the output shaft is slidable in an axial direction. When the male helical splines of the output shaft are brought into contact with the stopper, relative rotation of the helical splines is restricted, thereby to stop the axial movement of the output shaft.

9 Claims, 2 Drawing Sheets

STARTER WITH STOPPER ON CLUTCH INNER PORTION OF ONE-WAY CLUTCH

CROSS REFERENCE TO RELATED APPLICATION

This application is based on Japanese Patent Application No. 2003-64791 filed on Mar. 11, 2003, the disclosure of which is incorporated herein by reference.

FIELD OF THE INVENTION

The present invention relates to a starter having a planetary reduction gear device that reduces the rotation speed of a motor and transmits the rotation to a clutch outer portion of a one-way clutch.

BACKGROUND OF THE INVENTION

As an example of a starter having a planetary reduction gear device, a starter disclosed in JP-Y2-H6-23742 is known. As shown in FIG. 2, the starter has a planetary reduction gear device 120, a one-way clutch, an output shaft 150, and a pinion gear 160. The planetary reduction gear device 120 reduces the rotation speed of a motor 100 and transmits the rotation to a clutch outer portion 110 of the one-way clutch. The output shaft 150 slidably engages with an inner periphery of a clutch inner portion 130 of the one-way clutch through helical splines 140. The pinion gear 160 is provided on the end of the output shaft 150 on a side opposite to the motor 100. In starting an engine, the pinion gear 160 moves with the output shaft 150 to the left side in FIG. 2, thereby to engage with a ring gear of the engine.

In the starter, the output shaft 150 moves to the left side while rotating along the helical splines 140. When a stopper 170, which is formed on the output shaft 150, strikes a side face of a bearing 190 supported in a housing 180, the axial movement of the output shaft 150 is stopped. In this construction, after the stopper 170 strikes the bearing 190, a thrust force applied to the output shaft 150 through the helical splines 140 are likely to be largely applied to the bearing 190 and the housing 180. As a result, the bearing 190 and the housing 180 are likely to be damaged.

Further, by a reaction force caused when the stopper 170 strikes the bearing 190, the one-way clutch receives a thrust force in a direction of the motor 100, that is, to the right side in FIG. 2. This thrust force may result in defects to the operation of the one-way clutch and the reduction of the rotation.

SUMMARY OF THE INVENTION

The present invention is made in view of the foregoing matters, and it is an object of the present invention to provide a starter capable of reducing a thrust force due to helical splines after an axially forward movement of an output shaft is stopped.

According to the present invention, a starter has a motor generating a rotation force, a planetary reduction gear device that reduces a speed of the rotation of the motor, and a one-way clutch that transmits the rotation force from the planetary reduction gear device to an output shaft. The one-way clutch includes a clutch outer portion, a roller and a clutch inner portion. The torque is transmitted from the clutch outer portion to the clutch inner portion through the roller. The clutch inner portion forms female helical splines on its inner peripheral wall and the output shaft forms male helical splines engaging with the female helical splines. The output shaft is disposed movable in the inner periphery of the clutch inner portion through the helical splines.

Further, the cutch inner portion has a stopper on its inner periphery. The stopper is disposed to receive the end of the helical splines of the output shaft while the output shaft moves in a direction opposite to the motor, thereby to stop the movement of the output shaft.

Accordingly, when the end of the male helical splines contacts the stopper, the relative rotation between the male helical splines and the female helical splines is restricted and thereby to stop the movement of the output shaft. Since the relative rotation of the helical splines is restricted, it is less likely that the output shaft receives a thrust force. Further, it is less likely that a bearing, which supports the output shaft, and a housing will receive large loads.

BRIEF DESCRIPTION OF THE DRAWINGS

Other objects, features and advantages of the present invention will become more apparent from the following detailed description made with reference to the accompanying drawings, in which.

DETAILED DESCRIPTION OF EMBODIMENT

Figure 1:
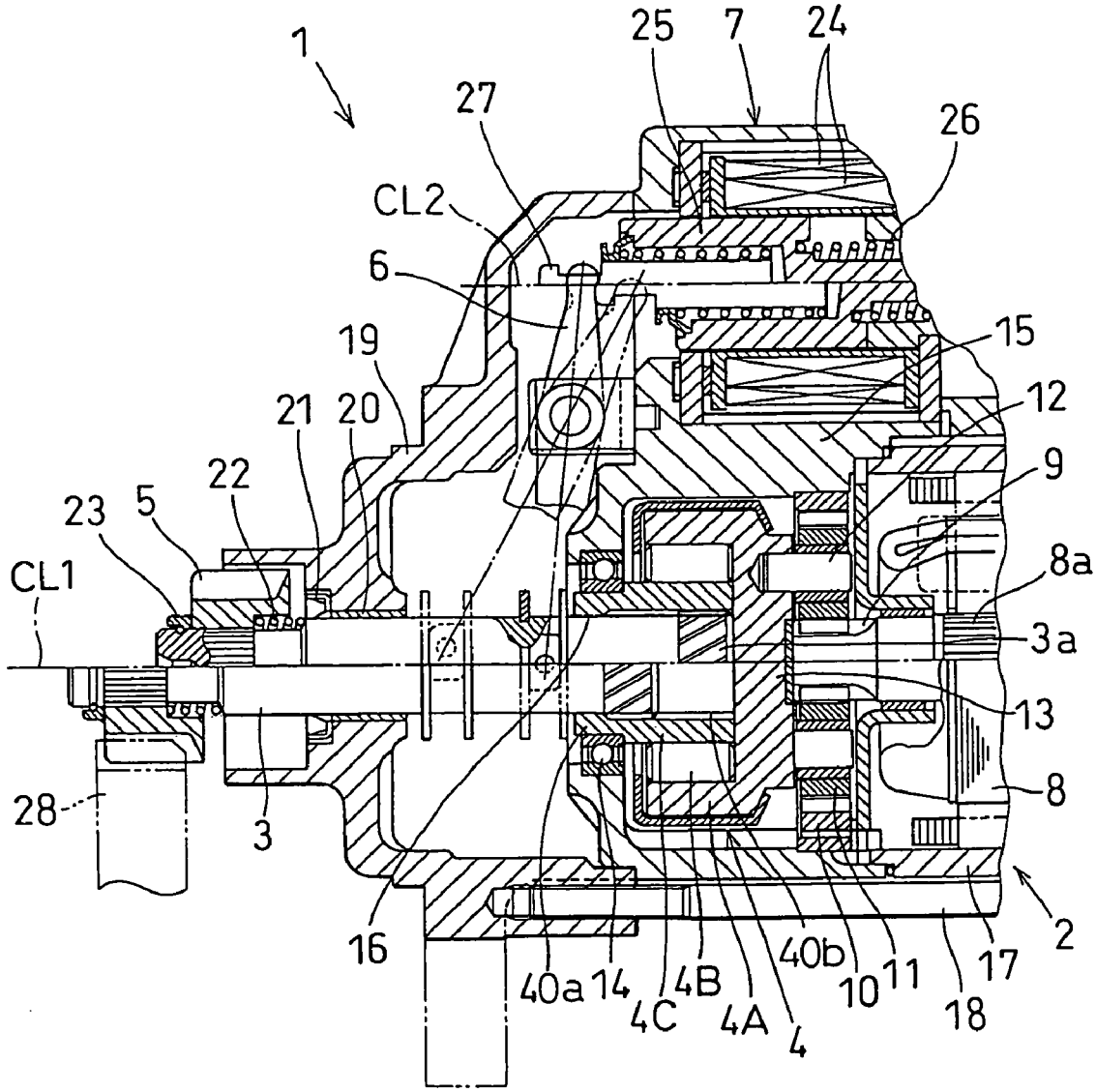
FIG. 1 is a cross-sectional view of a starter according to an embodiment of the present invention.
Figure 2:
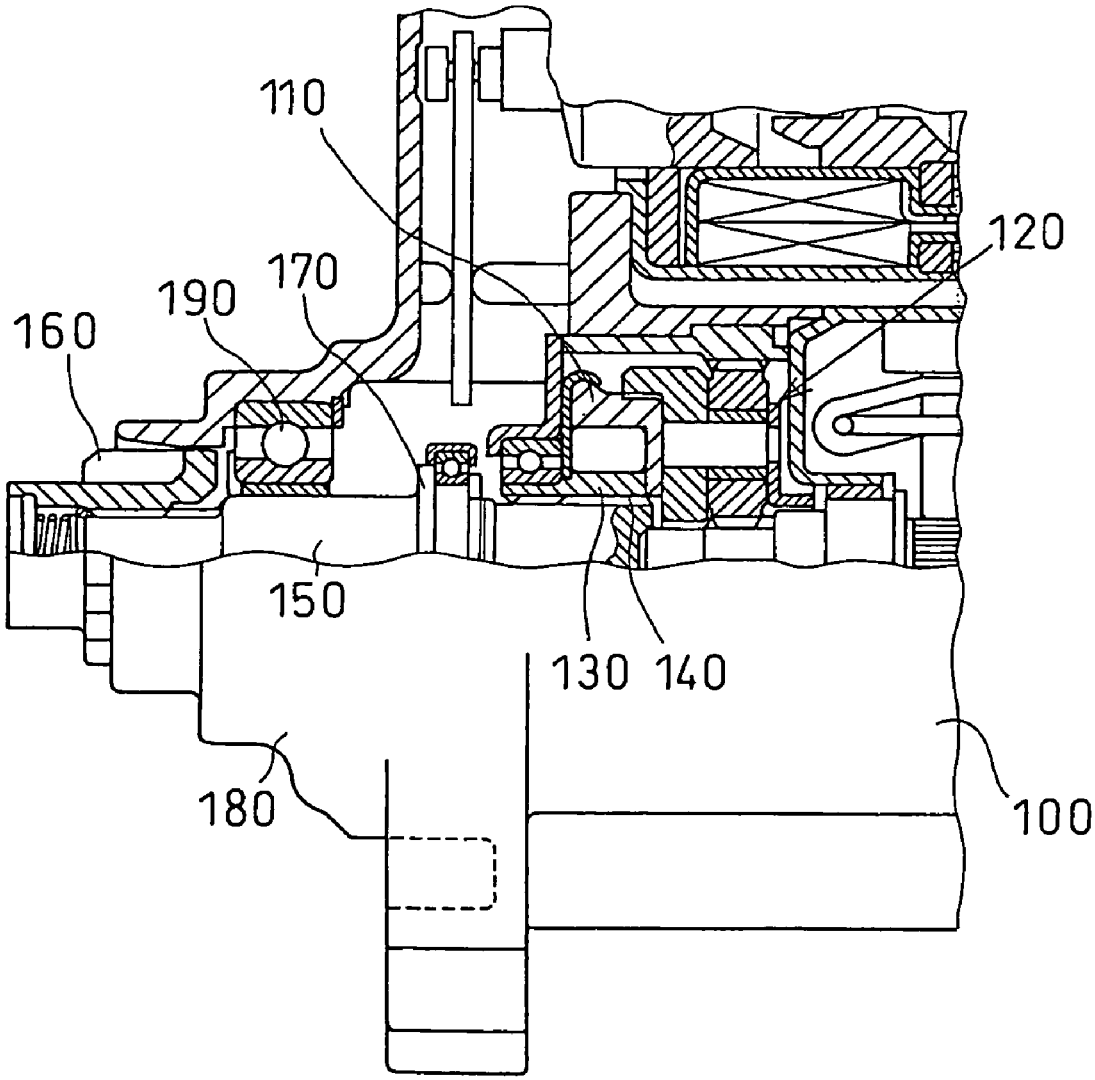
FIG. 2 PRIOR ART
FIG. 2 is a cross-sectional view of a starter of a prior art.

An embodiment of the present invention will be described hereinafter with reference to the drawing.

As shown in FIG. 1, a starter 1 of the embodiment is constructed of a motor 2, an output shaft 3, a one-way clutch 4, a pinion gear 5, a shift lever 6, an electromagnetic switch 7, and the like. The motor 2 generates a rotation force. The planetary reduction gear device reduces a speed of the rotation of the motor 2. The one-way clutch 4 transmits the rotation, the speed of which is reduced by the planetary reduction gear device, to the output shaft 3. The pinion gear 5 is provided on the output shaft 3. The electromagnetic switch 7 switches on and off an electric current supply to the motor 2 and moves the output shaft 3 in an axial direction through the shift lever 6.

The motor 2 is a d.c. motor. When a motor contact (not shown) accommodated in the electromagnetic switch 7 is closed, an armature 8 of the motor 2 receives an electric power supply from a vehicle-mounted battery, and therefore the armature 8 generates a rotational force.

The planetary reduction gear device has a sun gear 9, an internal gear 10 and a plurality of planetary gears 11. The sun gear 9 is formed on a rotation shaft 8*a* of the motor 2. The internal gear 10 is in a form of ring and arranged concentric with the sun gear 9. The planetary gears 11 are disposed to engage with the sun gear 9 and the internal gear 10. The speed of the rotation from the armature 8 is reduced by rotation (rotational movement and revolution movement) of the planetary gears 11. The planetary gears 11 are rotatably supported by gear shafts 12 that are held by a carrier 13. The revolution movements of the planetary gears 11 are transmitted to the carrier 13.

The one-way clutch 4 is a roller-type clutch, which is generally used in starters. The one-way clutch 4 is constructed of a clutch outer portion 4A, a roller 4B, and a clutch inner portion 4C. The clutch outer portion 4A is provided as a part of the carrier 13 and synchronously rotates with the revolution movement of the planetary gears 11, that is, rotates with the rotation that is reduced in speed through the planetary reduction gear device.

The carrier 13 provides a separation wall portion. As shown in FIG. 1, the separation wall portion extends in a radial direction to the outside diameter of the clutch outer portion 4A between the rotation shaft 8*a* of the motor 2 and the output shaft 3. Thus, the carrier 13 encases the one-way clutch 4 and a rear end (right end in FIG. 1) of the output shaft 3 in the form of bag or cap. Hereafter, the left side in FIG. 1 is referred to as a front side of the starter 1 and the right side in FIG. 1 is referred to as a rear side of the starter 1, for illustrative purposes.

The roller 4B is arranged in a cam chamber (not shown) that is defined in an inner periphery of the clutch outer portion 4A. The roller 4B is held between the inner peripheral wall of the clutch outer portion 4A and an outer peripheral wall of the clutch inner portion 4C. When the clutch outer portion 4A rotates, the roller 4B transmits the torque from the clutch outer portion 4A to the clutch inner portion 4C.

The clutch inner portion 4C forms a bearing portion 40*a* at its front end (left end in FIG. 1), which is on a side opposite to the motor 2. The bearing portion 40*a* is located closer to the pinion gear 5 than contact surfaces of the roller 4B and the clutch inner portion 4C with respect to the axial direction. A clutch bearing 14 is provided on an outer periphery of the bearing portion 40*a*. The clutch inner portion 4C is rotatably supported in a center case 15 through the bearing 14. Female helical splines 40*b* are formed on an inner periphery of the clutch inner portion 4C. The female helical splines 40*b* are formed by cold forging with twisting process. Further, a stopper 16 is formed on an inner periphery of the bearing portion 40*a* for restricting an advanced position of the output shaft 3.

The center case 15 surrounds the planetary reduction gear device and the one-way clutch 4. The center case 15 is connected to the front end of a motor yoke 17. The center case 15 is fixed to a front housing 19 together with an end cover (not shown) by a through bolt 18.

The output shaft 3 is rotatably supported in the front housing 19 through a front bearing 20. Male helical splines 3*a* are formed on the rear end portion of the output shaft 3. The output shaft 3 is inserted in the inner periphery of the clutch inner portion 4C such that the male helical splines 3*a* engage with the female helical splines 40*b*. Thus, the output shaft 3 is movable in the axial direction through the relative rotation of the helical splines 3*a*, 40*b*. A sealing member 21 is provided at an axial front end (left end in FIG. 1) of the bearing 20 for restricting the entry of water and dusts into the housing 19. The sealing member 21 is for example an oil sealing.

The pinion gear 5 is connected to the front end of the output shaft 3 that protrudes axially forward from the bearing 20. The pinion gear 5 engages with the output shaft 3 through splines and is rotatable with the output shaft 3. The pinion gear 5 is held in a condition biased forward, that is, to the left side in FIG. 1 by a pinion spring 22 and in contact with a collar 23 that is provided axially forward of the pinion 5.

The electromagnetic switch 7 has a coil 24 that is electrically conducted by a switching operation of a starting switch (not shown), a plunger 25 disposed to reciprocate inside of the coil 24, and the like. When the coil 24 is excited, the plunger 25 is attracted to the right side of FIG. 1 while compressing a spring 26, as illustrated under a centerline CL2 in FIG. 1. With the movement of the plunger 25, a shift lever 6, which is connected to the plunger 25 through a hook 27, is operated, so the output shaft 3 is pushed forward, that is, in a direction opposite to the motor, and the motor contact is closed.

Next, operation of the starter 1 will be described.

When the coil 24 of the electromagnetic switch 7 is excited and the plunger 25 is attracted, the output shaft 3 is pushed in the direction opposite to the motor through the shift lever 6. The male helical splines 3*a* slides along the female helical splines 40*b*, so the output shaft 3 moves with respect to the clutch inner portion 4C to the front side while rotating. After the pinion gear 5 contacts a ring gear 28 of an engine, the output shaft 3 temporarily stops in a condition that the pinion spring 22 is compressed.

On the other hand, when the motor contact is closed by the movement of the plunger 25, the armature 8 is electrically conducted and starts to rotate. The rotation of the armature 8 is transmitted to the clutch outer portion 4A after the speed of the rotation is reduced by the planetary reduction gear device. Further, the torque is transmitted to the clutch inner portion 4C from the clutch outer portion 4A through the roller 4B. As a result, the clutch inner portion 4C rotates and the rotation of the clutch inner portion 4C is transmitted to the output shaft 3. When the output shaft 3 rotates to a position where the pinion gear 5 can engage with the ring gear 28, the output shaft 3 once again moves in the direction opposite to the motor by receiving a thrust force. When the front end of the male helical splines 3*a* of the output shaft 3 are brought into contact with the stopper 16 of the clutch inner portion 4C, the output shaft 3 stops, as illustrated under a centerline CL1 in FIG. 1.

Accordingly, the pinion gear 5 is pushed by the reaction force of the pinion spring 22 and meshes with the ring gear 28, and the rotation of the output shaft 3 is transmitted to the ring gear, thereby to crank the engine.

After cranking the engine, when the starting switch is turned off, the electric power supply to the coil 24 is stopped and the magnetic force, that is, the attraction force, disappears. Therefore, the plunger 25 is pushed back to an original position by receiving the reaction force of the spring 26, as illustrated above the centerline CL2 in FIG. 1. With the return movement of the plunger 25, the motor contact is opened, thereby stopping the electric power supply to the armature 8.

When the plunger 25 returns to the original position, the output shaft 3 returns to the right side in FIG. 1 through the shift lever 6, as illustrated above the centerline CL 1 in FIG. 1. After the pinion gear 5 separates from the ring gear 28, the axial rear end of the output shaft 3 is brought into contact with the end face of the carrier 13, so the movement of the output shaft 3 is stopped.

In the starter 1, the stopper 16 is provided on the clutch inner portion 4C on which the female helical splines 40*b* are formed. When the front end of the male helical splines 3*a* contacts the stopper 16, the relative rotation of the male helical splines 3*a* and the female helical splines 40*b* is restricted. By this, the axial movement of the output shaft 3 is stopped. Since the relative rotation of the helical splines 3*a*, 40*b* is restricted, the output shaft 3 will not receive a thrust force. Accordingly, it is less likely that the front bearing 20 supporting the output shaft 3, the front housing 19 and the like will receive large load.

Also, the stopper 16 of the clutch inner portion 4C is provided on the inner diameter side of the bearing portion 40*a*, which is supported through the bearing 14. The stopper 16 is formed at a position corresponding to the bearing 14 with respect to the axial direction. Therefore, the load caused when the male helical splines 3*a* of the output shaft 3 strike the stopper 16 can be directly received by the bearing 14. In this case, since a moment load is not applied to the bearing 14, the bearing 14 can be reduced in size. Further, as compared with a case in which the bearing 14 and the stopper 16 are provided separately in the axial direction, the axial length of the clutch inner portion 4C can be reduced in the embodiment. With this, the total axial length of the starter 1 can be reduced. Furthermore, the mountability of the starter 1 is improved.

Generally, it is difficult to form the female helical splines 40*b* by rolling or broaching. In the embodiment, the female helical splines 40*b* of the clutch inner portion 4C are formed by cold forging with twisting. Therefore, the female helical splines 40*b* are easily formed at low costs. Further, the strong stopper 16 can be produced.

In the starter 1, it is constructed such that the rotation the speed of which is reduced in the planetary reduction gear device is transmitted to the clutch outer portion 4A of the one-way clutch 4. Therefore, the clutch outer portion 4A is provided as a part of the carrier 13 of the planetary reduction gear device. That is, the clutch outer portion 4A and the carrier 13 are provided from a single piece. If the carrier 13 and the clutch outer portion 4A are separately provided, the loss in the toque transmission will be increased. In the embodiment, however, the carrier 13 and the clutch outer portion 4A are provided from a single part, the torque transmission loss is reduced and the axial length is decreased.

Further, the carrier 13 covers the one-way clutch 4 and the rear end of the output shaft 3 in the form of bag or cap. Therefore, the engaging portions, that is, sliding portions, of the female helical splines 40*b* and the male helical splines 3*a* are substantially entirely isolated from the motor 2. As a result, it is less likely that brush powder generated in the motor 2 and abrasion powder of the gears will enter the engaging portions of the helical splines 3*a*, 40*b*. Accordingly, it is possible to sufficiently maintain the slidability of the clutch inner portion 4C and the output shaft 3. Furthermore, it is less likely that grease of the helical splines 3*a*, 40*b* will scatter. Accordingly, the life of the helical splines 3*a*, 40*b* is improved.

Further, the carrier 13 functions as a back stopper that restricts the axially back position of the output shaft 3 when the output shaft 3 returns after staring the engine, that is, the stationary position of the output shaft 3 when the starter 1 halts. Therefore, shock load generated when stopping the backward movement of the output shaft 3 can be received by the strong carrier 13. Therefore, it is not required to provide a back stopper additionally. Accordingly, the configuration is simplified.

The present invention is not limited to the above embodiments, but may be implemented in other ways without departing from the spirit of the invention.

What is claimed is:

1. A starter comprising:

a motor that generates a rotation force;

a planetary reduction gear device that reduces speed of the rotation of the motor;

a one-way clutch that has a clutch outer portion receiving the rotation from the planetary reduction gear device, a roller, and a clutch inner portion receiving torque from the clutch outer portion through the roller, the clutch inner portion having helical splines on an inner periphery;

an output shaft that has helical splines engaging with the helical splines of the clutch inner portion and is disposed movably in an axial direction in the inner periphery of the clutch inner portion through relative rotation of the helical splines; and a pinion gear disposed on the output shaft and movable with the output shaft in a direction opposite to the motor, wherein the clutch inner portion is provided with a stopper on the inner periphery, and the stopper is disposed to receive the end of the helical splines of the output shaft when the output shaft is moved in the direction opposite to the motor, thereby to stop the movement of the output shaft, the output shaft has a first end and a second end, the second end being closer to the motor than the first end and disposed in the inner periphery of the clutch inner portion, the clutch outer portion has a separation wall that extends in a radial direction to an outside diameter of the clutch outer portion axially between a rotation shaft of the motor and the second end of the output shaft, and the separation wall fully covers an axial end of the one way clutch and an axial end face of the second end of the output shaft and is disposed such that an axial end face of the second end of the output shaft is brought into contact with the separation wall when the output shaft is moved toward the motor.

2. The starter according to claim 1, wherein the helical splines of the output shaft are male helical splines, and the helical splines of the clutch inner portion are female helical splines formed by cold forging with twisting.

3. The starter according to claim 1, wherein the clutch inner portion has a bearing portion, which is supported through a bearing, at an end that is on a side opposite to the motor with respect to the axial direction, and the stopper is located in an inner periphery of the bearing portion.

4. The starter according to claim 3, wherein the bearing is disposed on an outer periphery of the bearing portion.

5. The starter according to claim 1, wherein the separation wall is disposed to receive an axial end face of the second end of the output shaft for stopping the output shaft when the output shaft moves toward the motor.

6. The starter according to claim 1, wherein the planetary reduction gear device includes a plurality of planetary gears each having a gear shaft, and the separation wall rotatably supports the gear shafts as a carrier.

7. The starter according to claim 6, wherein the separation wall portion and the clutch outer portion are formed into a single piece.

8. The starter according to claim 1, further comprising:

a housing for housing the output shaft and the one-way clutch; and a bearing disposed in the housing, wherein a clutch inner portion further includes a bearing portion on a radially outside of an end thereof, the stopper is located radially inside of the bearing portion, and the bearing is located radially outside of the bearing portion of the clutch inner portion, so that the second end of the output shaft is supported by the bearing through the clutch inner portion, when the output shaft is moved in the direction to the motor and the ends of the helical splines of the output shaft contact the stopper.

9. The starter according to claim 8, wherein the bearing is a first bearing, the starter further comprising:

a second bearing supported in the housing at a position separated from the first bearing in the axial direction, wherein the second bearing directly supports the output shaft.

* * * * *